US007509842B2

(12) United States Patent
Kostuj

(10) Patent No.: US 7,509,842 B2
(45) Date of Patent: Mar. 31, 2009

(54) WAGGLE WEIGHT

(76) Inventor: William A. Kostuj, 1539 Highland Ave., Glendale Heights, IL (US) 60139

( * ) Notice: Subject to any disclaimer, the term of this patent is extended or adjusted under 35 U.S.C. 154(b) by 0 days.

(21) Appl. No.: 11/261,722

(22) Filed: Oct. 27, 2005

(65) Prior Publication Data

US 2006/0094524 A1 May 4, 2006

Related U.S. Application Data

(60) Provisional application No. 60/622,996, filed on Oct. 28, 2004.

(51) Int. Cl.
*A63B 53/00* (2006.01)

(52) U.S. Cl. ..... 73/65.03

(58) Field of Classification Search ..... 73/65.03
See application file for complete search history.

(56) References Cited

U.S. PATENT DOCUMENTS 3,817,522 A * 6/1974 Simmons ..... 473/332
4,203,598 A * 5/1980 Stuff et al. ..... 473/287
4,319,750 A * 3/1982 Roy ..... 473/320
4,343,473 A * 8/1982 Laursen ..... 473/256
5,249,803 A * 10/1993 Giffin ..... 473/256
6,821,209 B2 * 11/2004 Manwaring et al. ..... 473/198
6,831,603 B2 * 12/2004 Menache ..... 342/463
7,063,627 B2 * 6/2006 Mindlin ..... 473/267
2006/0094490 A1 * 5/2006 Reeeves ..... 463/16

* cited by examiner

*Primary Examiner*—Max Noori

(57) ABSTRACT

A pre-swing waggle weight rotation point location and a waggle weight specification measurement are disclosed that are provided about a golf club. A process that may be computer implemented establishes the waggle weight point location. A waggle weight scale with a fulcrum set to the waggle weight point may be utilized to determine the waggle weight. Disclosed is producing golf clubs with the waggle weight measurement.

24 Claims, 7 Drawing Sheets

WAGGLE WEIGHT

This application claims priority to U.S. provisional application Ser. No. 60/622,996 filed Oct. 28, 2004, the entire disclosure of which is herein incorporated by reference.

TECHNICAL FIELD & BACKGROUND

The present invention generally relates to the field of golf clubs. More specifically, the present invention relates to a waggle weight specification as applied on golf clubs.

There is a constant search in the golfing industry to find new ways to help increase the performance of golfers. The present invention delivers enhanced performance by providing higher quality feedback to golfers from golf clubs.

A swing is any movement begun with a conscious intent to strike a golf ball or simulated golf ball. A pre-swing starts with any thought or action to prepare for striking the golf ball or simulated golf ball and ends with the start of the swing. An address is a portion of the pre-swing initiated when taking one's stance over the golf ball and ended with the start of the swing.

A waggle is a motion performed during the pre-swing that provides feedback to a golfer regarding the golf club about to be swung. A waggle usually produces a rotation point about a golf club, named a waggle weight point. The rotation results in an effective club head weight (could also be interpreted as an effective golf club total weight) sensed by the golfer when performing a waggle. This effective weight sensed during the pre-swing, named a waggle weight, can greatly impact on one's setup and subsequent golf swing. The purpose of the waggle weight specification is to attain consistent perceptions of golf club head weight at the instant each golf stroke begins.

One area of difficulty preventing the accomplishment of higher quality feedback to make more precise golf clubs is tranditional swing weighting. Swing weight scales use a previously determined fulcrum position, almost always fourteen inches, rarely twelve, from the grip end to a golf club, to make golf clubs to particular swing weighs. The problem is swing weighting is a one-size-fits-all attempt to balance and match various golf clubs to different golfers in an effort to improve playability.

For many golfers swing weight does not work effectively. The present invention positions a function at a determined waggle weight point. Golf clubs can now be produced based on waggle weight. Waggle weight is an alterable, measurable golf club value instituted when a golf club is placed against a fulcrum located at a waggle weight point. Using the present invention, golf clubs henceforth can be efficiently scaled for far more golfers than has ever been possible before. Once a waggle weight point is matched to a particular pre-swing style, an assessment to determine a waggle weight value can take place based on the waggle weight point position. Upon finding a preferred waggle weight, golf clubs can be made to the waggle weight in order to improve golfers consistency of swinging and performance.

The waggle weight specification may be used on any type golf clubs, including but not limited to traditional designations like woods, irons, and putters.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Embodiments of the present invention include, but are not limited to, a waggle weight point disposed about a golf club and the golf club having a waggle weight specification, a waggle weight scale with a fulcrum, a method for establishing a waggle weight point, determining a waggle weight, and producing at least one golf club with the waggle weight, a computer-implemented process for locating a waggle weight point, and systems for locating a waggle weight point, determining a waggle weight, and generating golf clubs with the waggle weight specification.

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention, however, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising," "having," and "including" are synonymous, unless the context dictates otherwise.

Figure 1A:
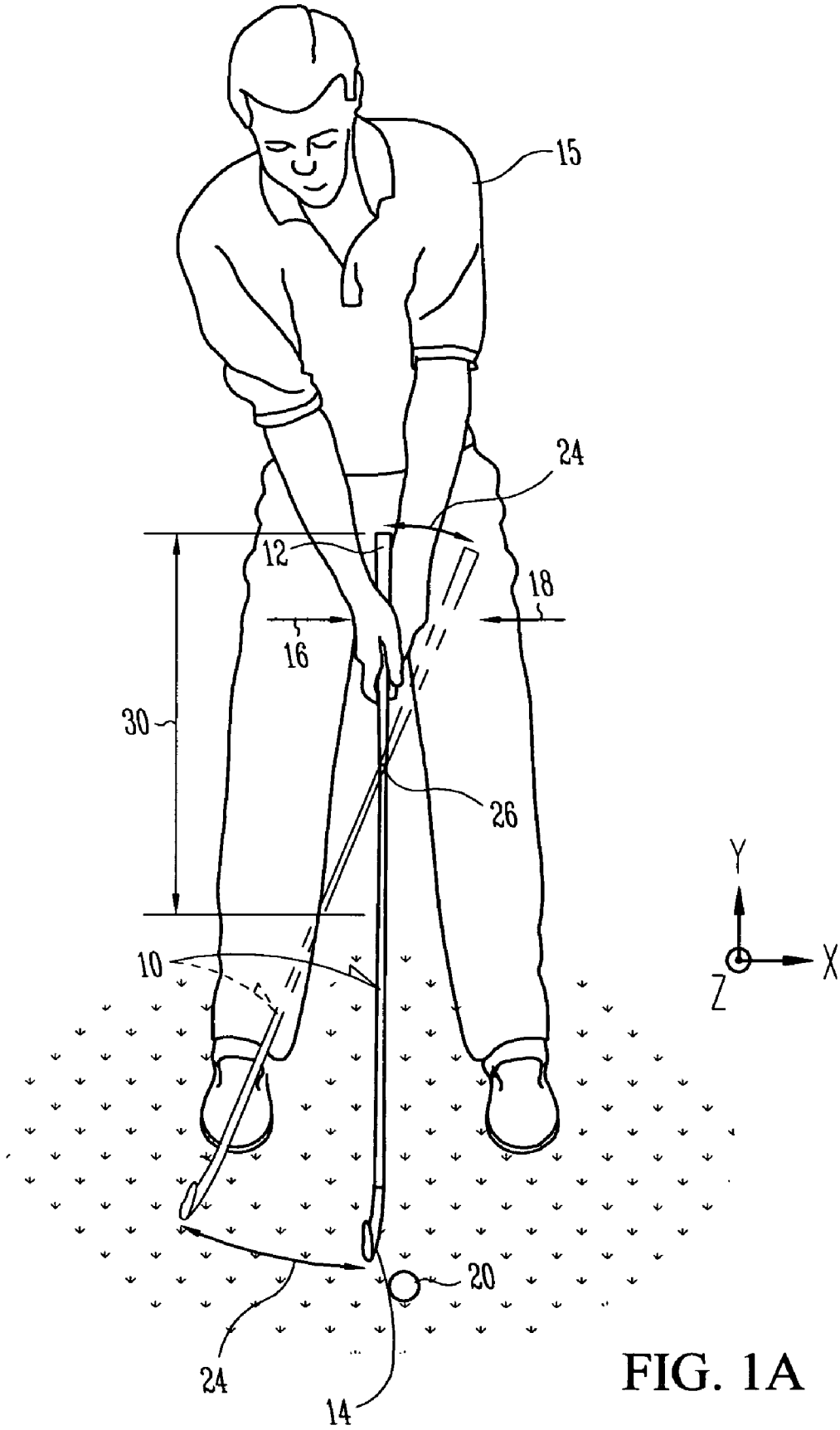
FIG. 1A illustrates a drawing of a golf club and a golfer in accordance with one embodiment of the present invention.

Referring now to FIG. 1A, three dimensions X, Y, and Z are shown. Illustrated is a golf club 10 having a grip end 12 and a club head end 14. Also portrayed are a first force 16 and a second force 18 that are applied to the golf club 10 by a golfer 15, thereby creating one common form of waggle movement. The pre-swing, address and any waggle or waggles occur while preparing to hit a golf ball 20, before the golfer 15 begins a swing. Some golfers might waggle only once prior to staring their swings, while others may repeat the maneuver many times ahead of attempting to strike the golf ball 20. A waggle motion habitually produces a rotation 24 of the golf club 10 about a waggle weight point 26. The waggle weight point location 26 may be specific to each golfer 15 and can vary substantially from golfer to golfer based on individual pre-swing routines. All golfers' waggle weight points will lie within a waggle weight point range. The waggle weight point range 30 shown could be a range from the grip end 12 (0 inches) to the mid-point of the golf club's 10 length and may be considered a reasonable waggle weight point range 30 based upon the history of golf. However, the waggle weight point location 26 may occur anywhere along the length axis of the golf club 10. During any given period of time, a golfer's waggle weight point may generally be located in the same approximate area relative to the grip end 12 of a golf club, regardless of the overall length of the golf club.

Figure 1B:
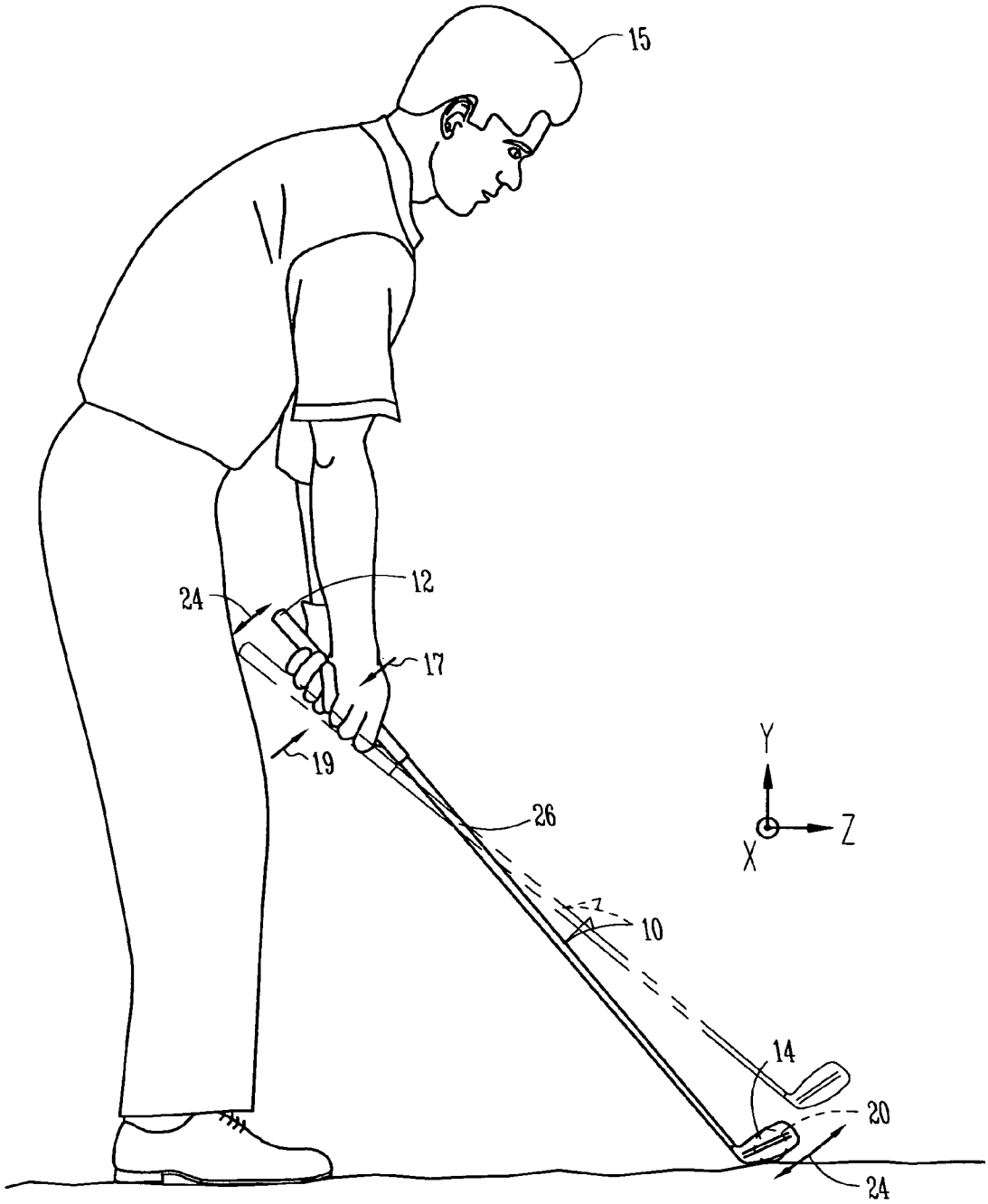
FIG. 1B illustrates another drawing of a golf club and a golfer, in accordance with one embodiment of the present invention.

Referring now to FIG. 1B, three dimensions X, Y, and Z are shown. Illustrated are a golf ball 20 and a golf club 10 having a grip end 12 and a club head end 14. Also portrayed are a third force 17 and a fourth force 19 that are applied to the golf club 10 by a golfer 15, thereby creating another common form of waggle movement. Gravitational energy about the golf club may be felt by the golfer in the course of such movement. Waggle motions habitually produce a rotation 24 of the golf club 10 about a waggle weight point 26.

While the embodiments portrayed in FIGS. 1A and 1B could each be the all-inclusive waggle style of two different golfers, the two depictions may also represent individual segments of a more comprehensive waggle of a single golfer, with movements shown in FIGS. 1A and 1B that could occur during different time frames. Waggles, therefore, can have three-dimensional components, with rotation points (point positions could be in the same place or different locations) that may be observable and analyzable from different planes of view as well as at different times during a golfer's pre-swing waggling. Waggle movements, including those portrayed in FIGS. 1A and 1B, can involve the entire body, and may contain other vertical, horizontal, and even circular golf club motion ingredients. Still other forms of pre-swing waggling can occur and be completed even before a golfer addresses a golf ball, yet may ultimately affect golfing performance equally to that of address waggling.

Figure 2:
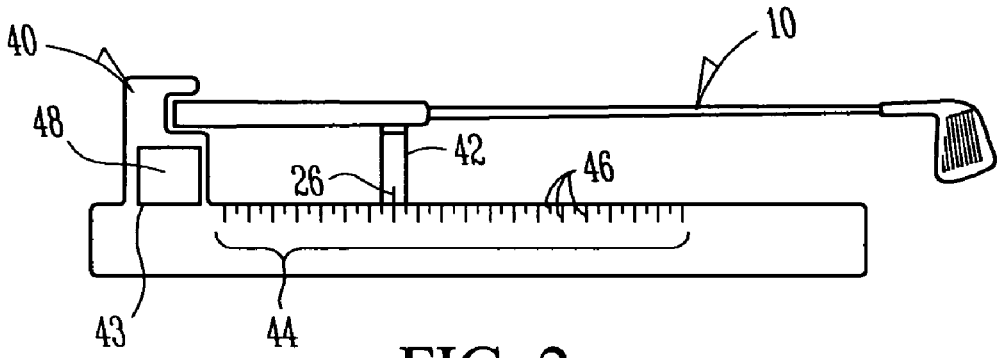
FIG. 2 illustrates a drawing of a waggle weight scale with an electronic display, in accordance with one embodiment of the present invention.

Referring to FIG. 2, illustrated is one embodiment of a waggle weight scale 40 with a fulcrum 42 and an electronic display 43. The fulcrum 42 may be permanently fixed at one point or may be variable. It is understood that the electronic display 43 could be placed on the waggle weight scale 40 or the electronic display 43 could be in any other location such as remotely connected that would operably couple the electronic display 43 to the waggle weight scale 40 while allowing an operator to view the electronic display 43 conveniently. The fulcrum 42 will be set to the waggle weight point 26 of FIGS. 1A and 1B, assuming identical locations for the waggle weight point 26 in both figures. For variable fulcrum waggle weight scales, a waggle weight rule 44 may be included. The rule 44 can have increments 46 to allow the fulcrum 42 to be set at a position that corresponds to the waggle weight point 26 location. The waggle weight rule 44 may have increments 46 to each 1/32nd of an inch or 1 millimeter. The electronic display 43 will read out a value that is equal to the waggle weight 48 of the golf club 10. The waggle weight 48 of a golf club 10 can be modified, often by, though not limited to, altering the club head weight of the golf club 10. Waggle weight scale pre-programming may be furnished in order to supply varying waggle weight balance readings at each accessible waggle weight point fulcrum location.

Successive values of swing weight on past swing weight scale designs are distinguished by changes of one eighth of an ounce of weight deviation on the very end of a golf club at the grip side for the standard, fourteen-inch, fixed-fulcrum scale model, over a range of generally 11½ through 19 ounces. Variations of one tenth of an ounce, usually throughout a range of 0 to 28 ounces, characterize consecutive readings on the twelve-inch, static-fulcrum model, called the Official Scale. The lower numbers on the Official Scale are conventionally used for measuring the gross weights of individual golf club components or assembled golf clubs and are not ordinarily used for swing weighting. The foregoing figures can be considered for a waggle weight scale configuration, or an entirely new format may be developed as desired. Addressing this particular parameter could warrant initially matching a test group of golfers with their respective waggle weight points precisely. Additional research might then be conducted regarding how much a golf club's balance about the players' respective waggle weight points needs to be manipulated before they notice a difference in performance. It may be discovered that weight change statistics surrounding waggle weight do not coincide with values chosen for previous golf club balancing scales, thus promoting design revision in this area.

Figure 3:
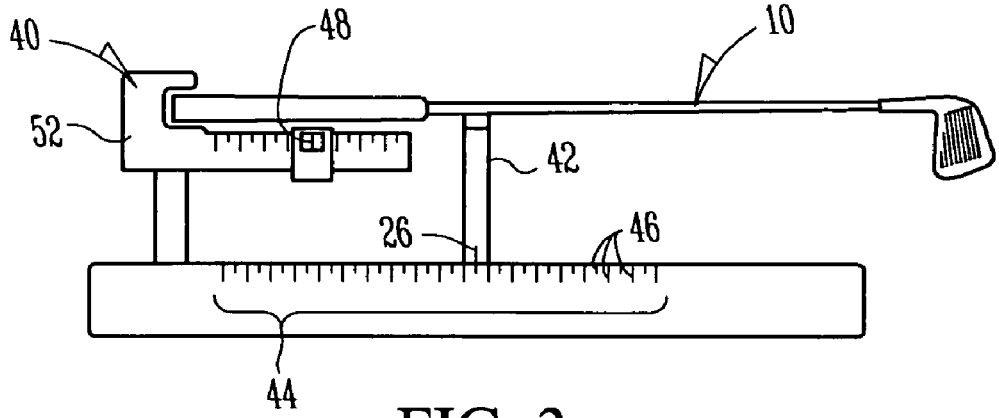
FIG. 3 illustrates a drawing of a waggle weight scale with a mechanical display, in accordance with one embodiment of the present invention.

Referring to FIG. 3, illustrated is another embodiment of a waggle weight scale 40 with a fulcrum 42 and a mechanical balance 52. Again the fulcrum 42 will be set to the waggle weight point 26 of FIG. 1A and FIG. 1B, assumed to be at like positions in both depictions. A waggle weight rule 44 may be included with variable fulcrum waggle weight scales and can include increments 46 to allow the fulcrum 42 to be conveniently and precisely set at a position that corresponds to the waggle weight point 26 location. The mechanical balance 52 might be alterable in order to provide accurate waggle weight values as the fulcrum position varies. Sliding the movable weight 48 until the golf club 10 is balanced on the fulcrum 42 will provide a reading that is equal to the waggle weight 48 of the golf club 10.

Notwithstanding perhaps the inclusion of waggle weight point location information as part of a waggle weight value, balance-changing unit designations on a waggle weight scale 40 may be formatted to any used for previous swing weight scale designs, such as ounces, grams, or inch-ounce numbers represented by assigned letter-number labels including C-5, D-2, and E-0, or a completely new measuring scheme can be devised. Each available waggle weight point position may have its own distinct formulation for defining and designating waggle weights. Consequently, variable-fulcrum waggle weight scales might incorporate appropriate designs to achieve scale recalibrations throughput the accessible waggle weight point range. It may be possible to convert some existing swing weight scale models into waggle weight devices without completely starting from the beginning, depending upon validated waggle weight scale parameters.

The waggle weight of a golf club may be figured by manual calculation in lieu of a waggle weight scale. For each individual golf club, a balance point can be located as a spot where a fulcrum is positioned when the golf club rests perfectly horizontal on the fulcrum. A total weight of the golf club is measured at this center of gravity location, and a distance is determined from this same point to the very end of the golf club at the grip side. From this length is subtracted a decided waggle weight point, which is also a distance from the grip end of the golf club. The difference is multiplied by the above-measured weight in order to obtain a rotational force, or torque, existing at the waggle weight point. If the lengths are measured in inches and the weight in ounces, the calculation result will be in units of inch-ounces. Inch-ounce numbers can be referenced against designations that may be developed for waggle weight values in order to obtain the waggle weight of the golf club. Dividing an inch-ounce figure by the waggle weight point distance can reveal the exact amount of weight required to be placed on the very end of the golf club at the grip side in order to balance the golf club in equilibrium when the club is resting level on the fulcrum at the waggle weight point, for which reference material may also be made available. This waggle weight calculation, and the scales portrayed in FIGS. 2 and 3, may indicate the gravity (vertical) force component(s) felt by a golfer when waggling, characterized by a sensation of operative golf club head weight or total weight and more closely depicted by forces 17 and 19 in the movement of FIG. 1B. If lateral pre-swing energies (more closely associated with FIG. 1A and forces 16 and 18) and/or any other energies developed and felt during waggling are deemed to be as crucial or even more so toward subsequent swing performance, then other apparatus to measure those forces around waggle weight points and help make golf clubs accordingly can be devised/utilized as desired.

Figure 4:
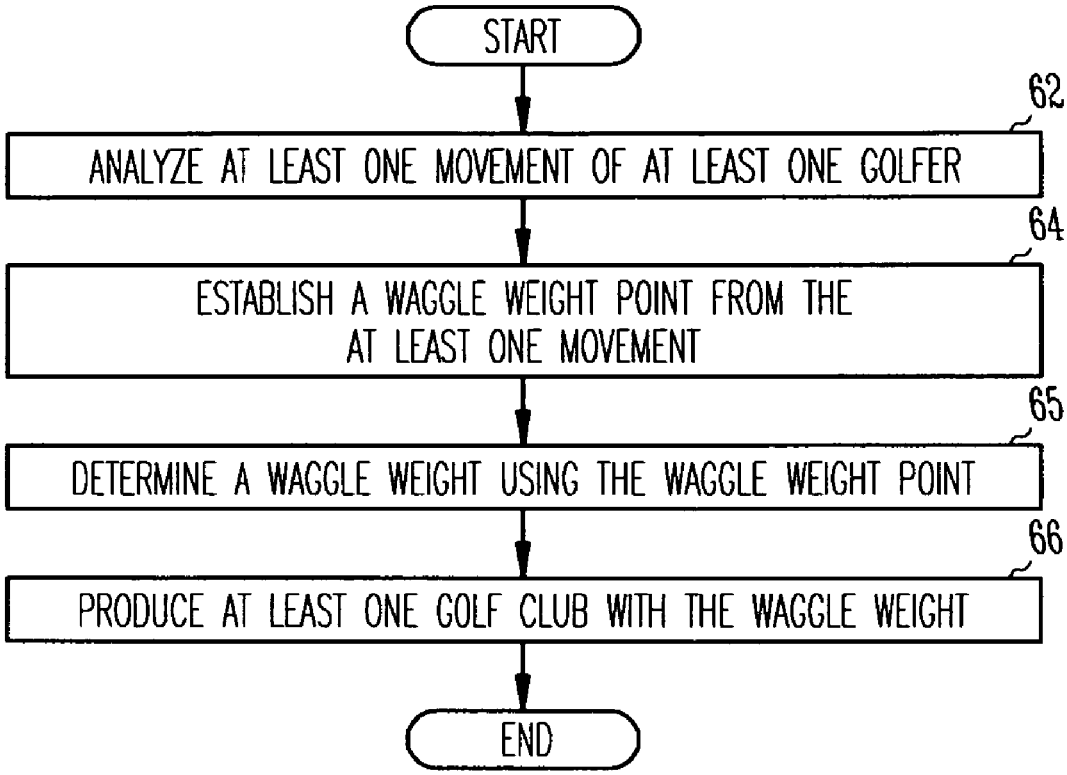
FIG. 4 illustrates a flow chart of a method, in accordance with one embodiment of the present invention.

Referring to FIG. 4, an embodiment is illustrated providing a method to produce golf clubs with a waggle weight. Shown are analyze at least one movement of at least one golfer 62 and establish a waggle weight point from the at least one movement 64. A waggle weight point location might be positively ascertained through the use of a computer-implemented process. An attempt to locate a waggle weight point position may also be made by human observation. Forasmuch as waggle weight points are found out from information acquired before a swing is begun, the hitting of golf balls and even golf club swinging may not be essential in order to succeed at finding waggle weight point positions. Establishing the waggle weight point location might be based on the pre-swing waggling motion of a single player, or the point's position could be an average of multiple findings conducted within appointed golfer categories. In cases where perhaps different planes of analysis, separate waggles, and/or other factors may reveal variant waggle weight points for the same individual, further investigation might be initiated to determine which waggle weight point and its associated pre-swing action is most crucial to the golfer's subsequent swing performance, or selected results could be averaged. Also depicted is determine a waggle weight using the waggle weight point 65. It may be desired to not reevaluate for waggle weight point location each time a waggle weight is determined, in which case the waggle weight point utilized may be a previously decided position from a former probe. Golfing performance might be evaluated at various golf club waggle weight measures about the placed waggle weight point. A preferred waggle weight may be selected. The waggle weight choice could be secured by the analysis of a specific golfer, or the decision might be supported by a larger study. Waggle weight readings can be obtained by using a waggle weight scale. Waggle weight values may also be manually figured. Subsequently shown is produce at least one golf club with the waggle weight 66.

A "golfer representation" may be used in place of or in addition to a real golfer, said representation of which might be a video reproduction or a computer simulation of golfer pre-swing/swing movement, not limited to these possibilities.

Multiple golf clubs produced into what may commonly be referred to as a set or matching set of clubs, made to successive half-inch length increments with otherwise identical components and features, can exhibit different playing characteristics when applying waggle weight in comparison to traditional swing weight. When matching golf clubs using the long accepted fourteen-inch swing weight scale, an increase of approximately seven grams of head weight of each successively shorter golf club is required. For matched waggle weighted clubs, however, waggle weight point locations longer than fourteen inches may need an increased slope of head weights, for example nine grams per club head, as the set progresses in the same half-inch length increments. Shorter waggle weight point distances can require a shallower slope of head weights throughout the set, thereby producing club head wights and total golf club weights that become more equal to each other as one's waggle weight point location approaches zero. Zero may apply only to those who perform no pre-swing activity. In addition to new club construction, the waggle weight method can also be applied on existing golf clubs.

Figure 5:
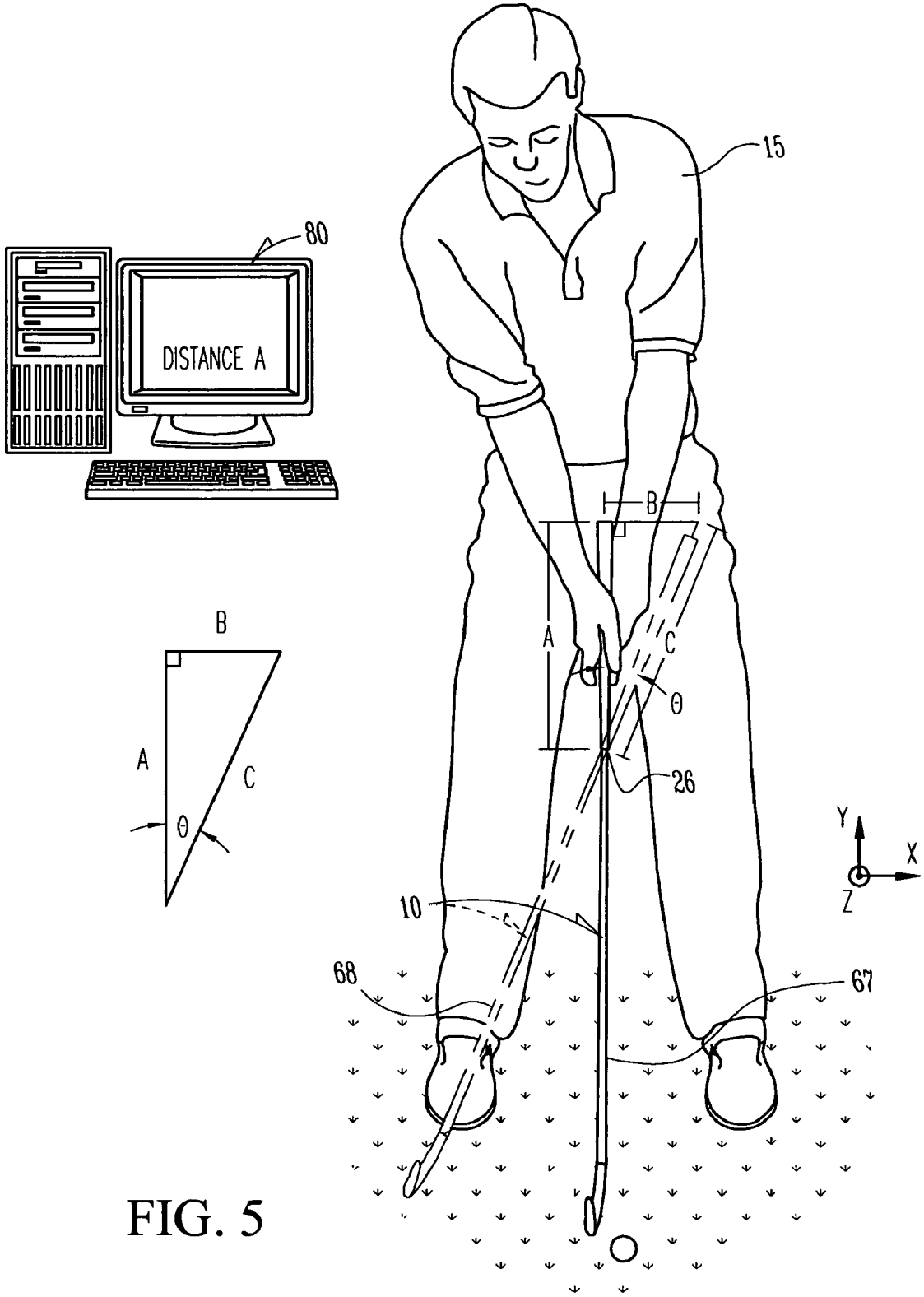
FIG. 5 illustrates a drawing of a golf club, a golfer, and a computer-implemented process, in accordance with one embodiment of the present invention.

Referring to FIG. 5 is a computer-implemented process for calculating the location of a waggle weight point 26. Illustrated are dimensions X, Y, and Z. Due to the complexities of golfers' waggle motions, computer implementation to authoritatively and consistently locate waggle weight points precisely is significant toward effective golf club waggle weighting for golfers. Provided is collecting golf club motion data and locating a waggle weight point 26 from the data. A waggle weight point 26 may correspond to a fulcrum rotation point developed during pre-swing waggling and can be calculated by a computer 80. Shown is a first waggle postion 67 where facts can be collected. Data may also be gathered at a second waggle position 68. In calculating the waggle weight point 26 location, the waggle weight point 26 can be equal to a distance A. Computer-generated vectors may be created to produce a right triangle ABC. Where angle θ may be an angle between the first waggle position 67 and a second waggle postion 68. Where B can be a distance between the first waggle postion 67 and the second waggle position 68 and is at a right angle to A. Where A may be calculated as $A=B/\tan\theta$. Tangent solutions for angles are widely available from mathematical source material. Automated calculation of waggle weight points can be rendered using a primary computer-implemented process by design. Exceeding that, it may be desirable to compose a more detailed computer-implemented process, which might save and reproduce all relevant golfing action in a manner more understandable and useful than can be realized without a computer-implemented process. One example could be a pre-swing first saved as data and then exhibited in slow motion video, whereby with such a tool a waggle weight point might be obtained, studied, and explained in a more manual manner if desired, yet with considerable precision due to the decisive computer-implemented process. Furthermore, the saved data can be referenced against any past/future examination in order to monitor for changes in pre-swing movement and/or waggle weight point. In consequence, a computer-implemented process to locate waggle weight points might also be utilized for perhaps research and teaching purposes.

With scientific means now available to more accurately and authoritatively determine any golfer's waggle weight point than could be accomplished by human observation alone, a computer-implemented process may also be applied to subsequently help determine golfers' waggle weights, based perhaps on the swing timing and/or other determined characteristics of analyzed golfers.

Figure 6:
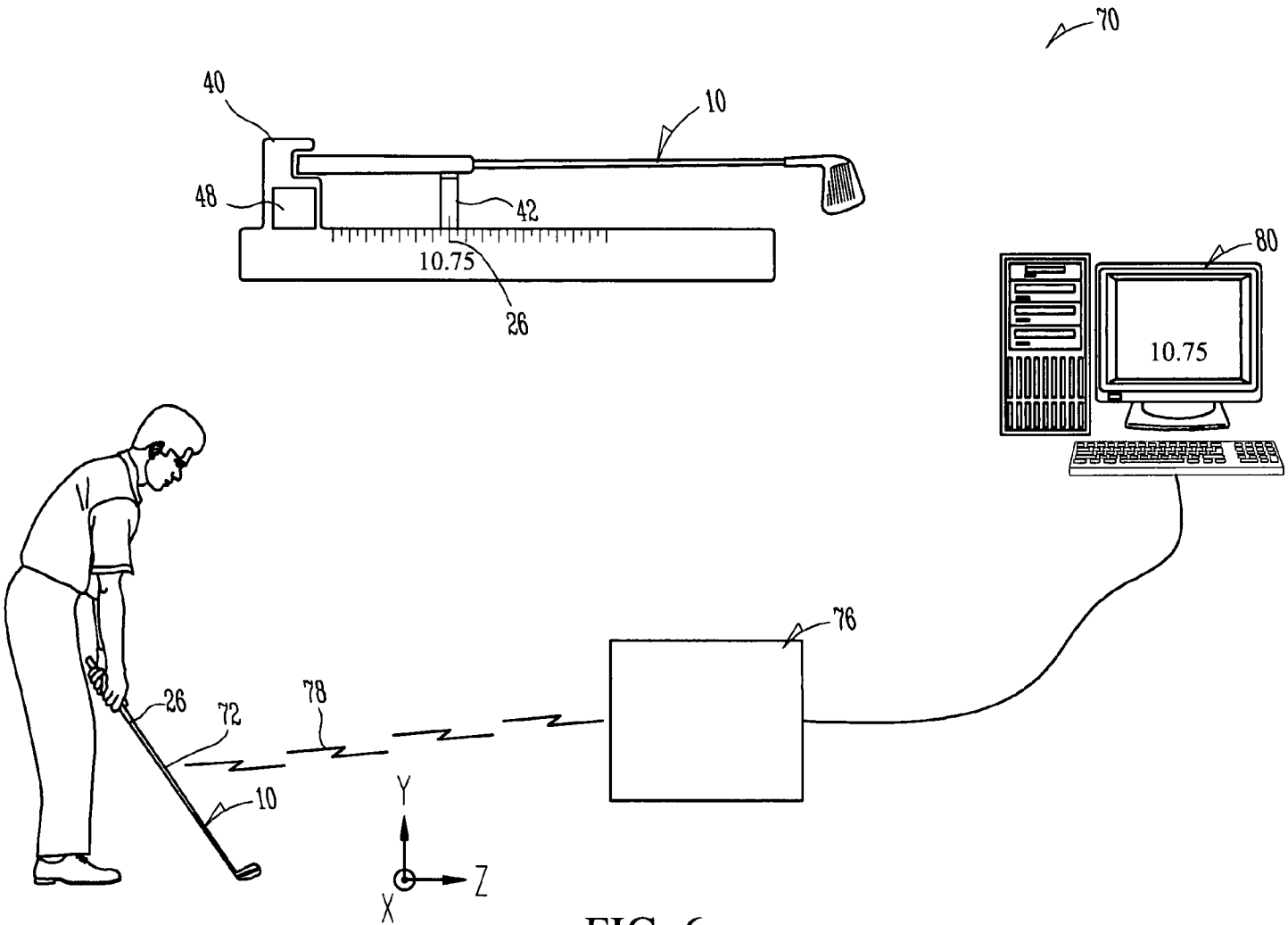
FIG. 6 illustrates a system to produce a golf club with a waggle weight, in accordance with one embodiment of the present invention.

Referring to FIG. 6, a system 70 is illustrated to locate a waggle weight point 26 and derive a waggle weight 48. Three dimensions X, Y and Z are shown. A golf club 10 might be outfitted with at least one transmitter 72 that may be capable of presenting adequate information to position a waggle weight point, whereupon the golf club 10 could be a first test golf club. The transmitter(s) can likewise be placed on the golfer being tested if appropriate. The transmitter(s) 72 may supply at least one signal 78 to track movement of the golf club 10. If the signal(s) 78 from the transmitters(s) 72 cannot be directly analyzed by a computer 80, at least one receiver 76 can be employed that could acquire and format the signal(s) 78 from the transmitter(s) 72. The computer 80 intakes information from the receiver(s) 76 and may utilize a computer-implemented process to decipher the location of a waggle weight point 26 disposed about the golf club 10 during a golfer's pre-swing waggle or waggles. A scale 40 with a fulcrum 42 has its fulcrum 42 set to the waggle weight point 26 location. When the fulcrum 42 is set at a position that corresponds to the waggle weight point 26, a waggle weight 48 can be derived on a golf club 10. Waggle weight 48, which is alterable, may then be analyzed. Given is determining the golfer's waggle weight. This could be accomplished by using a golf club 10, thereupon the golf club 10 might be a second test golf club, and the scale 40 with its fulcrum 42 set at the waggle weight point 26 postion. Various waggle weight values can be tried and rated pursuant to the golfer's performance. This would customarily be completed through hitting golf balls and scrutinizing ball travel characteristics following golf club contact and/or information obtained concerning the quality of performed swings. A computer-implemented process may also be designed and utilized for waggle weight determination in order to obtain more scientific results if desired. A favored waggle weight 48 may be selected. Accordingly provided is at least one golf club produced with the golfer's determined waggle weight. Additional golf clubs could also be formed to the golfer's, or any golfer's, determined waggle weight in order to better fit the specific movement of individual players.

First and second test golf clubs may take on several forms. For example, a first test golf club, which could be used for waggle weight point ascertainment, might be nothing more than a golfer's own personal club with at least one portable sensor means temporarily attached to the club, capable of determining or aiding in determining the location of a waggle weight point. Alternately, a specialized golf club may be fabricated that can be used for waggle weight point location detection in which at least one sensor could be permanently situated within the golf club and relevant sensor information pre-programmed into a computer process. A club/device having at least one external sensor means focused on it from a distance to determine a waggle weight point location could also be considered a first test golf club. Regarding a second test golf club, what might be exploited to determine a waggle weight, a golfer's own personal club may again be used and in fact it could be the identical golf club utilized as a first test golf club if it is suitable for both assignments. However, typical completed golf clubs usually do not allow for head weights to be adjusted downward enough to enable an acceptable testing range of waggle weight values, and even when possible a common procedure of adding and removing adhesive lead tape to club heads in order to change waggle weights can be awkward and time consuming. Therefore, a distinct golf club may also be designed for determining waggle weights. The club might have variable mass, changeable weights to permit accurate waggle weighting at different waggle weight point locations, as variant waggle weight points could necessitate applying differing weight magnitudes to change the waggle weight an equal amount on the same golf club. Specific weight measures may be tied to particular waggle weight point positions. Weight adjustments to alter waggle weight readings are typically made to the club head of a golf club, though not always. When not engaged in explicit duties, first and second test golf clubs are simply golf clubs. Generally speaking, using golf clubs with overall specifications as close as possible to what is believed best for the golfer or golfers being analyzed, or in place of that knowledge what might be considered within a normal range, may avoid undesirable imprecision during testing, as well as possible golfer injury.

Figure 7:
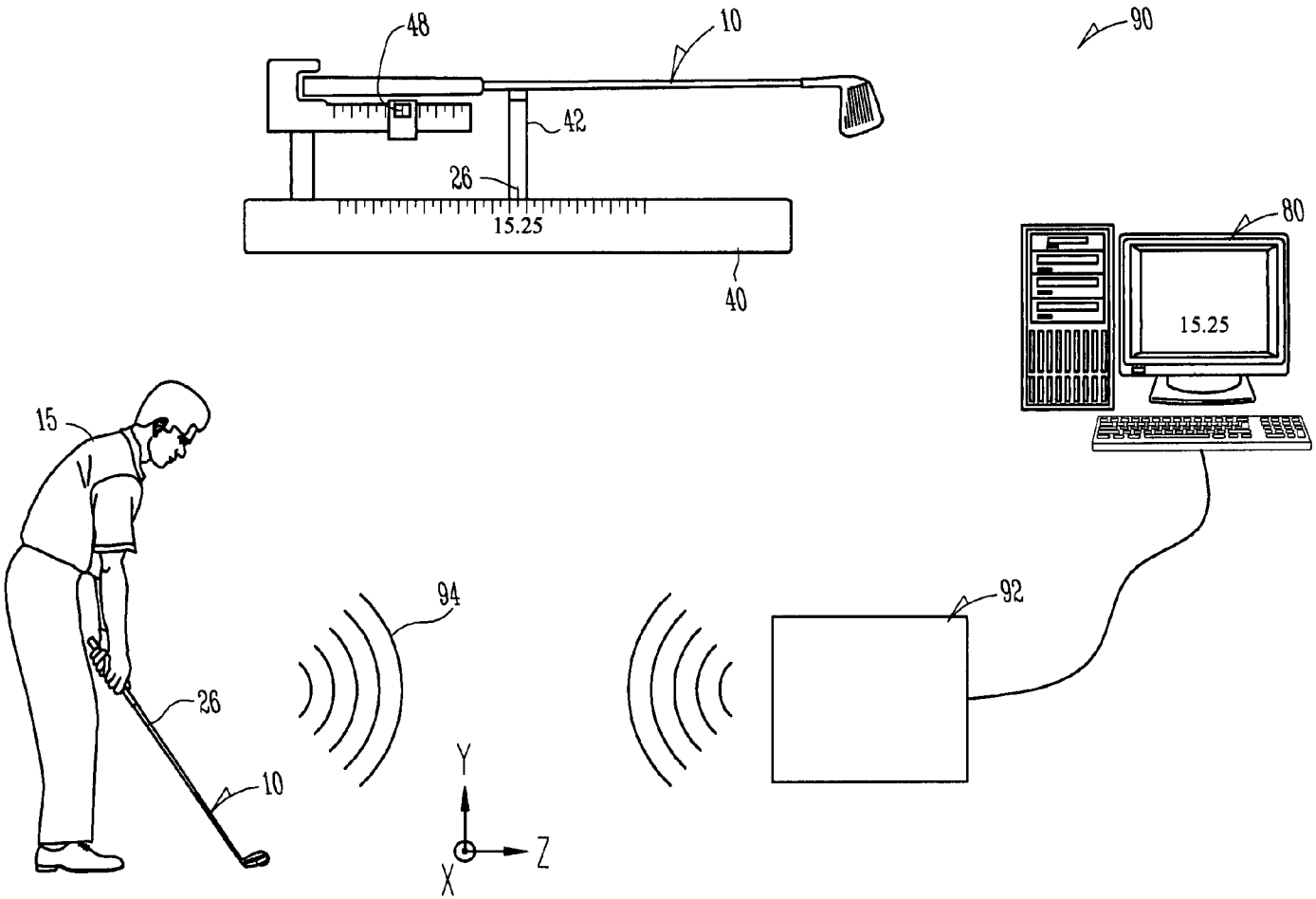
FIG. 7 illustrates another system to produce a golf club with a waggle weight, in accordance with one embodiment of the present invention.

Referring to FIG. 7, another embodiment of a system 90 to discover the position of a waggle weight point 26 and determine a waggle weight 48 is illustrated. Three dimensions X, Y and Z are shown. At least one sensor 92 is disposed about a golf club 10, at which point the golf club 10 can be a first test golf club. The sensor(s) 92 might be at least a selected one of a camera, an optical sensor, and an infrared sensor focused on the golf club 10. Note that sensor technology evolves fairly rapidly today with respect to both sensor types and/or functions, thus any desired sensor means may be designed and/or used. The at least one sensor could also be displayed about a golfer 15 if considered beneficial toward, as examples, establishing a waggle weight point and relating results more decisively. A computer 80 intakes data 94 from the sensor(s) 92 and may employ a computer-implemented process to interpret the data 94 and position a waggle weight point 26 disposed about the golf club 10 during a pre-swing. The procedure for locating a waggle weight point might be repeated multiple times with different golfers if perhaps the goal is to obtain an average waggle weight point position for a more mass-produced golf club operation. A scale 40 with a fulcrum 42 has its fulcrum 42 set to the selected waggle weight point 26 location. When the fulcrum 42 is placed at a position that corresponds with the waggle weight point 26, a waggle weight 48 of a golf club 10 is originated. Provided is determining a waggle weight, which is alterable. This may be achieved by utilizing a golf club 10, which during this step could be a second test golf club, and the scale 40 with its fulcrum 42 set to the waggle weight point 26 location. Different waggle weights measures can be tested and ranked for effectiveness based on golfing performance of the player or players being investigated. A preferred waggle weight 48 may be chosen. The waggle weight value might be based on golf ball flight/roll observation after being struck, golfer feedback concerning the feeling(s) sensed in the course of swinging, and/or computer data acquired throughout golfing activity. Subsequently given is making golf clubs to the waggle weight. A decided waggle weight could be applied to create an open-ended number of golf clubs aimed at benefiting either particular players or general player categories.

In addition to the advancements concerning complete golf clubs and golf club measuring devices covered herein by the present invention, the waggle weight specification can also be utilized to develop new and improved designs of golf club components including club heads, shafts, grips, and other clubmaking tools.

Thus, it can be seen from the above descriptions, a waggle weight specification applied on a golf club, a computer-implemented process for locating a waggle weight point, a novel device having a fulcrum set at a waggle weight point for determining waggle weights and producing golf clubs with waggle weights, a method for generating golf clubs with waggle weights, and systems utilizing said specification, method, process, and devices have been described. While the present invention has been related in terms of the foregoing embodiments, those skilled in the art will recognize that the invention is not limited to the embodiments depicted. The present invention can be practiced with modification and alteration within the spirit and scope of the appended claims.

Thus, the description is to be regarded as illustrative instead of restrictive on the present invention.

What is claimed is:

1. A method of determining a golf club rotation point location disposed about pre-swing movement, used in a golf club measurement, comprising:

analyzing at least one pre-swing movement of at least one golfer or golfer representation; and determining a preferred pre-swing golf club rotation point location from the analysis.

2. The method of claim 1, comprising determining at least one preferred golf club measurement of at least one force about the determined rotation point.

3. The method of claim 2, comprising producing at least one golf club using the at least one determined measurement.

4. The method of claim 1, wherein a computer-implemented process is used to aid in determining the rotation point location.

5. The method of claim 2, wherein the at least one measuring device with a fulcrum, the fulcrum placed at a location corresponding to the rotation point location, is used to aid in determining the at least one preferred measurement.

6. The method of claim 2, wherein a computer-implemented process is used to aid in determining the at least one golf club measurement.

7. A system to determine a golf club waggle weight point location used in a golf club waggle weight measurement, comprising:

a first test golf club having means to transmit pre-swing golf club motion data during at least one pre-swing movement of at least one golfer; and a computer means that receives and computes said data from the first test golf club to aid in determining a preferred golf club waggle weight point location.

8. The system of claim 7, comprising a second test golf club and a scale with a fulcrum, the fulcrum placed at a location corresponding to the waggle weight point location, used to determine a preferred golf club waggle weight measurement for the at least one golfer.

9. The system of claim 8, comprising at least one golf club produced with the determined waggle weight measurement.

10. The system of claim 7, wherein the first test golf club is essentially designed for the explicit purpose of originating and communicating pre-swing golf club motion data.

11. The system of claim 9, wherein the second test golf club is designed with adjustable, variable value weighting to accurately adjust waggle weight measurements when the waggle weight rotation point location varies.

12. The method of claim 2, wherein the at least one force is at least one of a vertical, horizontal, and circular force acting about the determined rotation point during pre-swing golf club movement.

13. The method of claim 1, wherein the preferred pre-swing golf club rotation point location is determined by an entity other than the entity that performs the pre-swing analysis.

14. The system of claim 8, wherein the scale measures at least one of a vertical, horizontal, and circular force acting about the waggle weight point.

15. A system to determine a golf club waggle weight point location used in a golf club waggle weight measurement, comprising:

at least one sensor means disposed about a first test golf club, said sensor means outputting first test golf club motion data during at least one pre-swing movement of at least one golfer; and a computer means that intakes and computes said data from the at least one sensor means to aid in determining a preferred golf club waggle weight point location.

16. The method of claim 3, wherein at least one measuring device with a fulcrum, the fulcrum placed at a location corresponding to the preferred rotation point location, is used to aid in producing the at least one golf club.

17. The method of claim 1, wherein at least one previous said analysis by at least one entity is used to aid in or substitute for said analysis.

18. The emthod of claim 1, wherein at least one golf club or golf club substitute is used to aid in the analysis.

19. The method of claim 2, wherein the least one preferred golf club measurement is determined by an entity other than the entity that determines the rotation point.

20. The method of claim 3, wherein the at least one golf club is produced by an entity other than the entity that determines the rotation point and/or the at least one preferred gold club measurement.

21. The system of claim 15, comprising a second test golf club and a scale with a fulcrum, the fulcrum placed at a location corresponding to the waggle weight point location, utilized to determine a preferred waggle weight measurement for the at least one golfer.

22. The system of claim 15, wherein the scale measures at least one of a vertical, horizontal, and circular force acting about the waggle weight point.

23. The system of claim 15, comprising at least one golf club made to the determined waggle weight measurement.

24. The system of claim 21, wherein the at least one sensor means is at least a selected one of a camera, an optical sensor, and an infrared sensor focused on the first test golf club.

* * * * *

UNITED STATES PATENT AND TRADEMARK OFFICE

CERTIFICATE OF CORRECTION

PATENT NO. : 7,509,842 B2
APPLICATION NO. : 11/261722
DATED : March 31, 2009
INVENTOR(S) : William A. Kostuj It is certified that error appears in the above-identified patent and that said Letters Patent is hereby corrected as shown below:

Title Page, item [54] and col. 1, line 1, TITLE, change from "WAGGLE WEIGHT" to --WAGGLE WEIGHT METHOD--.

Column 1, Line 1, see TITLE heading on Page 1 of Certificate of Correction; Line 24, delete "provides" and replace with --contributes--; Line 26, delete "results" and replace with --can result--; Lines 31-33, delete "golf swing. The purpose of the waggle weight specification is to attain consistent perceptions of golf club head weight at the instant each golf stroke begins." and replace with --golfing performance.--; Line 36, delete "tranditional" and replace with --traditional--; Line 37, delete "determined" and replace with --decided--; Line 38, delete "to" and replace with --of--; Line 39, delete "weighs" and replace with --weights--; Line 45, delete "function" and replace with --fulcrum--; Lines 50-51, delete "efficiently scaled for far more golfers" and replace with --better made to help improve the performance of golfers more--; Line 52, delete "matched to a particular" and replace with --determined based on--; Line 53, delete "style" and replace with --movement-- and delete "value" and replace with --measurement--; Line 55, add --any-- immediately before "golf" and delete "clubs" and replace with --club-- and delete "made to" and replace with --produced with--; Line 56, delete "waggle weight in order to improve golfers consistency" and replace with --determined measurement for the purpose--; Line 57, delete "swinging and" and replace with --improving golfer--; Line 59, delete "clubs" and replace with --club--; Line 61, entire paragraph (indented) missing comprising --Pre-swing perceptions and measurements of golf club characteristics other than "weight" and which can also greatly affect one's setup and subsequent golfing performance, may also be determined using the waggle weight invention. The waggle weight specification is not limited in its use to a golf-specific application. Any activity, whether athletic or non-athletic, where any "pre-swing" or "pre-action" movement may be performed prior to and in preparation for the generally accepted start of the action, may be able to have the waggle weight specification applied. Use of the waggle weight invention may aid in improving the fitting of a variety of equipment used in a variety of activities to a variety of performers.--.

Column 2, Line 29, delete "specification" and replace with --measurement--; Line 35, add --at least one-- in between "generating" and "golf" and delete "clubs" and replace with --club--.

Column 3, Line 2, delete "staring" and replace with --starting--; Line 10, delete "30" and replace with --30-- in between the words "shown" and "could"; Line 12, delete "30"; Line 13, delete "the" and replace with --a--; Line 14, delete "26"; Lines 14-15, It is certified that error appears in the above-identified patent and that said Letters Patent is hereby corrected as shown below:

delete "along the length axis of the" and replace with --about a--; Line 15, delete "10"; Line 29, delete "style" and replace with --styles--; Line 39, delete "waggling"; Line 40, delete "," immediately after "body"; Line 41, add --also-- immediately after "may" and add --golf club motion ingredients such as-- immediately after "other"; Lines 41-42, delete "golf club motion ingrdients. Still other" and replace with --movement. Other--; Line 44, delete "addresses" and replace with --begins to address-- and delete "may" and replace with --still--; Line 55, delete "will" and replace with --may--; Line 67 and Column 4, Line 1, delete "furnished in order to supply varying" and replace with --supplied in order to provide an appropriate range of--. Column 4, Line 17, delete "parameter" and replace with --design feature--; Line 18, delete "with" and replace with --to--; Line 19, delete "precisely"; Line 20, delete "a" and replace with --change in-- and delete "club's" and replace with --club--; Line 21, delete "be manipulated" and replace with --take place--; Line 22, delete "they notice" and delete "." and add --is observed.-- immediately after "performance"; Line 23, delete "surrounding" and replace with --concerning--; Line 29, delete "will" and replace with --may--; Line 36, add --(by weight as one example)-- after the word "alterable" and delete "accurate" and replace with --suitable--; Lines 37-39, delete "Sliding the movable weight 48 until the golf club 10 is balanced on the fulcrum 42 will provide a" and replace with --A--; Line 40, delete "." and add --is determined by sliding the movable weight (surrounding the waggle weight reading 48 and which may also be alterable) until the golf club 10 is balanced on the fulcrum 42.-- after "10"; Line 52, delete "throughput" and replace with --throughout--; Lines 53-56, delete "It may be possible to convert some existing swing weight scale models into waggle weight devices without completely starting from the beginning, depending upon validated waggle weight scale parameters."; Line 65, delete "is" and replace with --may-- and add --be-- in between "also" and "a".
Column 5, Line 10, immediately before the word "fulcrum" delete "the" and replace with --a--; Line 19, immediately before the word "felt" delete "and" and replace with --and/or--; Line 22, delete "those" and replace with --such--; Line 35, delete "positions" and replace with --locations-- and add --preferred-- in between "the" and "waggle"; Line 41, delete "points" and replace with --point locations even--; Line 44, delete "swing" and "or"; Line 45, delete "." and replace with --, or the waggle weight method may be applied to more than one point location.--; Line 47, add --a-- in between "for" and "waggle"; Line 49, delete "utilized" and replace with --used--; Lines 49-50, add --point-- in between "decided" and "position"; Line 50, add --then-- in between "might" and "be"; Line 51, delete "measures" and replace with --measurements--; Line 64, It is certified that error appears in the above-identified patent and that said Letters Patent is hereby corrected as shown below:

delete "of clubs" and add --for instance-- in between "made" and "to"; Line 65, delete "with otherwise identical" and replace with --and having other coordinated--; Line 66, delete "components" and replace with --components/features--.
Column 6, Line 3, immediately before the word "each" delete "of" and replace with --for--; Line 11, delete "wights" and replace with --weights--; Line 13, delete "approaches" and replace with --moves toward-- and delete "only"; Line 21, delete "authoritatively and consistently locate" and replace with --aid in locating--; Lines 21-22, add --more-- in between "points" and "precisely"; Line 22, add --and consistently-- immediately after "precisely"; Line 23, delete "Provided is" and replace with --The process comprises--; Line 26, add --a-- in between "during" and "pre-swing" and delete "waggling"; Line 27, delete "postion" and replace with --position--; Line 31, add --as golf club substitutes-- in between "created" and "to"; Line 34, delete "postion" and replace with --position--; Line 35, immediately before "67" delete "postion" and replace with --position--; Line 42, delete "," and "which" and replace with --that-- and add --analyze,-- in between "might" and "save" and add --,-- immediately after "save" and delete "all" and replace with --additional--; Line 43, delete "in a manner more understandable" and replace with --to provide a greater depth of understanding-- and delete "useful" and replace with --more usefulness--; Line 44, delete "without a" and replace with --with just a basic--; Line 53, delete "." and add --location.-- immediately after "point"; Line 54, delete "locate" and replace with --aid in locating--; Line 56, complete paragraph (indented) missing, comprising --A "golf club substitute" is defined as any means to help locate a golf club rotation point during pre-swing movement. A golf club substitute may take on many forms. One example may be a club with circuitry capable of sending pre-swing club movement data to a computer for further analysis. Another may be a computer-generated vector created and linked to a video representation of pre-swing golf club movement, whereby multiple vectors might be generated and placed at various pre-swing positions to aid in locating a pre-swing rotation point. Yet another example might be a straightedge-type device to sight along the edge of and reference against pre-swing movement to help in locating a rotation point. Like in many other activities, movement, including pre-swing movement, can be performed using only the limbs of one's body, and locating a pre-swing rotation point may be accomplished under this condition. In this circumstance, a "golf club substitute" may comprise only a single point of reference about a golfer. Using Figures 1A and 1B for reference, before any pre-swing movement is made a reference point location about a golfer 15 might be determined that may move correspondingly to a grip end of a golf It is certified that error appears in the above-identified patent and that said Letters Patent is hereby corrected as shown below:

club during pre-swing movement if a golf club were used. A point location along the edge of the golfer's arm as close as possible to where the grip end 12 of a golf club would regularly be positioned might be used as one example. Subsequently, the determined reference point could be followed during golfer pre-swing movement even in the absence of any golf club. A computer-implemented process might be used to aid in following the reference point more precisely. Following the reference point may produce movement in the form of an arc 24. A radius point location 26 of the formed arc, which might correspond to a pre-swing golf club rotation point location, may be determined from the arc dimension(s). The mathematical equation for determining the location of the radius point of an arc is widely available in mathematical reference materials. This manner of locating a pre-swing golf club rotation point may also be used when any golf clubs or other types of golf club substitutes are used to aid in locating the pre-swing golf club rotation point by following the actual point(s) determined to be the grip end(s) of the golf club(s) or golf club substitute(s).--; Lines 56-57, delete "and authoritatively"; Line 57, delete "any golfer's" and replace with --golfers'-- and delete "point" and replace with --points--; Line 64, delete "derive" and replace with --determine--.

Column 7, Line 3, delete "." and add --, on the golfer's hand(s) for example that may be covering up part of the first test golf club that might need to be analyzed.--; Line 4, delete "to track" and replace with --for tracking--; Line 5, delete "transmitters(s)" and replace with --transmitter(s)--; Line 11, delete "a" and replace with --the--; Line 14, delete "set" and replace with --placed--; Line 15, add --position-- after "26" and before ","; Lines 17-18, delete "the golfer's" and replace with --a preferred--; Line 21, delete "postion" and replace with --position--; Line 23, add --the-- in between "through" and "hitting"; Lines 23-24, add --of-- in between "hitting" and "golf"; Line 24, add --of-- in between "scrutinizing" and "ball"; Lines 24-25, delete "following" and replace with --, the quality of-- immediately after "characteristics"; Line 25, delete "club" and replace with --club/ball-- and add --,-- immediately after "contact" and delete "and/or"; Line 26, delete "the quality of performed swings." and replace with --swinging performance, and more.--; Line 31, delete "golfer's" and also delete "Additional" and replace with --All types of--; Line 32, delete "also"; Line 41, add --or golf-club-like device-- in between "club" and "may"; Line 44, delete "situated within the golf club and" and replace with --coupled to the club/device with-- and delete "sensor"; Lines 44-45, add --such as sensor location(s) and club/device length-- in between "information" and "pre-programmed"; Line 57, delete "weights" and replace with --weight values--; Line 61, delete "accurate" and replace with --convenient--.

UNITED STATES PATENT AND TRADEMARK OFFICE

CERTIFICATE OF CORRECTION

PATENT NO. : 7,509,842 B2
APPLICATION NO. : 11/261722
DATED : March 31, 2009
INVENTOR(S) : William A. Kostuj It is certified that error appears in the above-identified patent and that said Letters Patent is hereby corrected as shown below:

Column 8, Line 2, delete “are” and replace with --might-- and add --be-- in between “simply” and “golf”; Line 19, delete “displayed” and replace with --disposed--; Lines 21-22, delete “decisively” and replace with --clearly--; Lines 23-24, delete “interpret” and replace with --compute--; Line 24, delete “position” and replace with --aid in positioning--; Line 25, delete “The” (after the period) and replace with --A--; Line 26, add --preferred-- in between “a” and “waggle”; Line 30, add --a location corresponding to-- in between “to” and “the”; Lines 31-32, delete “a position that corresponds with the waggle weight point 26” and replace with --said location--; Line 33, add --measurement-- in between “weight” and “48”; Line 38, delete “weights measures” and replace with --weight measurements--; Line 41, add --preferred-- in between “The” and “waggle” and add --but not limited to-- in between “on” and “golf”; Line 45, delete “making” and replace with --at least one-- and delete “clubs” and replace with --club made--; Line 49, delete “complete” and replace with --completed (assembled)--; Line 52, delete “utilized” and replace with --applied--; Line 53, add --and-- immediately before “grips”; Line 54, delete “clubmaking tools” and replace with --club making and fitting devices--; Line 56, add --measurement-- in between “specification” and “applied”; Line 58, delete “set” and replace with --placed--; Line 59, add --a-- in between “determining” and “waggle” and delete “weights” and replace with --weight-- and add --a-- in between “producing” and “golf” and delete “clubs” and replace with --club--; Lines 59-60, add --a-- in between “with” and “waggle”; Line 60, delete “weights” and replace with --weight-- and add --at least one-- in between “generating” and “golf” and delete “clubs” and replace with --club--; Lines 60-61, add --a-- in between “with” and “waggle”; Line 61, delete “weights” and replace with --weight--; Line 62, delete “devices” and replace with --device-- and entire sentence missing in between “.” and “While” comprising --The application of the described aspects of the present invention culminates in a novel device of a golf club having a new and improved waggle weight specification measurement that aids in improving golfer performance.--.

UNITED STATES PATENT AND TRADEMARK OFFICE

CERTIFICATE OF CORRECTION

PATENT NO. : 7,509,842 B2
APPLICATION NO. : 11/261722
DATED : March 31, 2009
INVENTOR(S) : William A. Kostuj It is certified that error appears in the above-identified patent and that said Letters Patent is hereby corrected as shown below:

CLAIMS:
Claim 5, Line 21, within "wherein the at least one measuring device," the word "the" should be deleted; Line 23, within "corresponding to the rotation point location," the word --determined-- should be inserted immediately before "rotation".
Claim 10, Line 45, the words "essentially" and "explicit" should be deleted.
Claim 11, Line 47, "9" should be deleted and replaced with --8--; Lines 48-49, the word "accurately" should be deleted and replaced with --conveniently--.
Claim 18, Line 29, "emthod" should be deleted and replaced with --method--.
Claim 19, Line 31, within "wherein the least one preferred," the word --at-- should be inserted immediately before "least".
Claim 20, Line 36, "gold" should be deleted and replaced with --golf--.
Claim 22, Line 43, "15" should be deleted and replaced with --21--.
Claim 23, Line 46, "15" should be deleted and replaced with --21--.
Claim 24, Line 48, "21" should be deleted and replaced with --15--.

Signed and Sealed this

Seventh Day of July, 2009

JOHN DOLL
*Acting Director of the United States Patent and Trademark Office*